US010357418B1

(12) United States Patent
Little

(10) Patent No.: US 10,357,418 B1
(45) Date of Patent: Jul. 23, 2019

(54) STRETCH/EXERCISE TOWEL SYSTEM

(71) Applicant: Anthony A. Little, Tampa, FL (US)

(72) Inventor: Anthony A. Little, Tampa, FL (US)

(73) Assignee: Mindset Productions, LLC, Odessa, FL (US)

( * ) Notice: Subject to any disclaimer, the term of this patent is extended or adjusted under 35 U.S.C. 154(b) by 29 days.

(21) Appl. No.: 14/102,903

(22) Filed: Dec. 11, 2013

(51) Int. Cl.
*A61H 1/02* (2006.01)
*A63B 21/00* (2006.01)

(52) U.S. Cl.
CPC ..... *A61H 1/02* (2013.01); *A63B 21/00* (2013.01)

(58) Field of Classification Search
CPC ..... A45C 9/00; A45F 4/02; A63B 21/0023; A63B 2023/006
USPC ..... 482/10, 74, 91, 105, 121, 122, 124–126, 482/131, 139, 140, 907; 602/4; 383/4, 383/40; 220/660, 662, 664; 5/417, 419, 5/420; 15/209.1; 2/236, 237, 338, 467; 224/660, 662, 664
See application file for complete search history.

(56) References Cited

U.S. PATENT DOCUMENTS 1,922,169 A * 8/1933 Martin ..... 15/222
2,636,175 A * 4/1953 Hoffman, Jr. ..... 2/55
4,472,839 A * 9/1984 Johansen ..... 2/338
4,930,767 A * 6/1990 Hamm ..... 482/80
5,162,032 A * 11/1992 Dohner ..... 482/105
5,295,949 A * 3/1994 Hathaway ..... 602/18
5,498,218 A * 3/1996 Proctor et al. ..... 482/10
5,618,110 A * 4/1997 Sullivan ..... 383/4
5,913,757 A * 6/1999 Winters ..... 482/140
6,058,530 A * 5/2000 Wheeler ..... 5/417
6,296,164 B1 * 10/2001 Russo ..... 224/602
6,921,357 B2 * 7/2005 Basting ..... 482/121
7,063,650 B1 * 6/2006 Beausoleil ..... 482/105
7,587,768 B2 * 9/2009 Wong ..... 2/236
2004/0055075 A1 * 3/2004 Sullivan-West ..... 2/338
2005/0164854 A1 * 7/2005 Felberg et al. ..... 482/140
2005/0204501 A1 * 9/2005 Golec ..... 15/209.1
2005/0271857 A1 * 12/2005 Brody et al. ..... 428/78
2006/0189463 A1 * 8/2006 Boice et al. ..... 482/148
2008/0190980 A1 * 8/2008 Overton ..... 224/664

* cited by examiner

*Primary Examiner* — Andrew S Lo
(74) *Attorney, Agent, or Firm* — Blank Rome LLP

(57) ABSTRACT

A central section formed of plural plies has upper and lower edges, first and second side edges, and a centerline parallel with and equally spaced from the upper and lower edges. Left and right straps are formed of plural plies. Each strap has parallel interior and exterior edges and parallel upper and lower edges. Strap stitching extends through the plural plies of each strap perpendicular to the upper and lower edges. Coupling stitching joins the each strap to the central section at a location equally spaced between the upper and lower edges of the central section.

3 Claims, 3 Drawing Sheets

STRETCH/EXERCISE TOWEL SYSTEM

BACKGROUND OF THE INVENTION

Field of the Invention

The present invention relates to a stretch/exercise towel system and more particularly pertains to stretching and exercising most muscles of the upper and lower body of an end user allowing a greater range of motion to the end user for all types of flexibility exercises, the towel having multiple functions including user drying by wiping perspiration from the body of the end user during stretching and/or exercising, the stretching and/or exercising and the drying being done in a safe, convenient, and economical manner.

SUMMARY OF THE INVENTION

In view of the disadvantages inherent in the types of towel systems of known designs and configurations now present in the prior art, the present invention provides an improved stretch/exercise towel system. As such, the general purpose of the present invention, which will be described subsequently in greater detail, is to provide a new and improved stretch/exercise towel system and method which has all the advantages of the prior art and none of the disadvantages.

To attain this, the present invention essentially comprises a central section formed of plural plies. The central section has upper and lower edges. The central section has a centerline. The centerline is parallel with and equally spaced from the upper and lower edges. The central section has first and second side edges. A left strap and a right strap are provided. The straps are formed of plural plies. Each strap has an interior edge and an exterior edge. The left and right straps each have an upper edge and a lower edge. Strap stitching is provided. The strap stitching extends through the plural plies of each of the straps. The strap stitching is perpendicular to the upper and lower edges of the straps. Coupling stitching is provided to join the straps to the central section at a location equally spaced between the upper and lower edges of the central section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stretch/exercise towel system which has all of the advantages of the prior art towel systems of known designs and configurations and none of the disadvantages.

It is another object of the present invention to provide a new and improved stretch/exercise towel system which may be easily and efficiently manufactured and marketed.

It is a further object of the present invention to provide a new and improved stretch/exercise towel system which is of durable and reliable constructions.

An even further object of the present invention is to provide a new and improved stretch/exercise towel system which is susceptible of a low cost of manufacture with regard to both materials and labor, and which accordingly is then susceptible of low prices of sale to the consuming public, thereby making such stretch/exercise towel system economically available to the buying public.

Lastly, another object of the present invention is to provide a stretch/exercise towel system which is designed to allow an end user to easily get a greater range of motion with each stretch for most muscles of the upper and lower body for a greater stretch effect, the towel providing multiple functions including drying the end user through wiping off perspiration while exercising and/or stretching.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout, the various Figures.

DESCRIPTION OF THE PREFERRED EMBODIMENT

Figure 1:
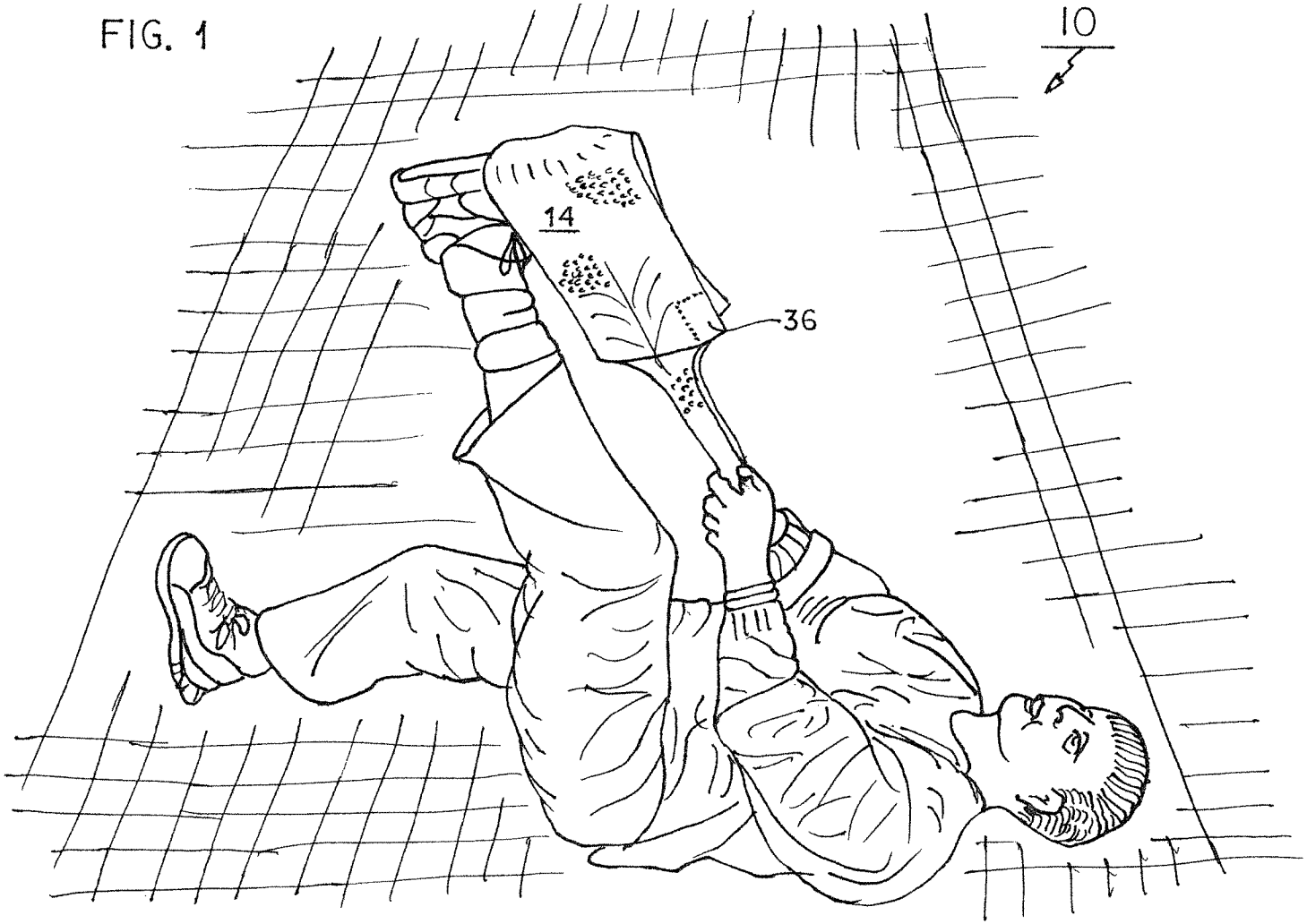
FIG. 1 is a perspective illustration of a stretch/exercise towel system constructed in accordance with the principles of the present invention.
Figure 2:
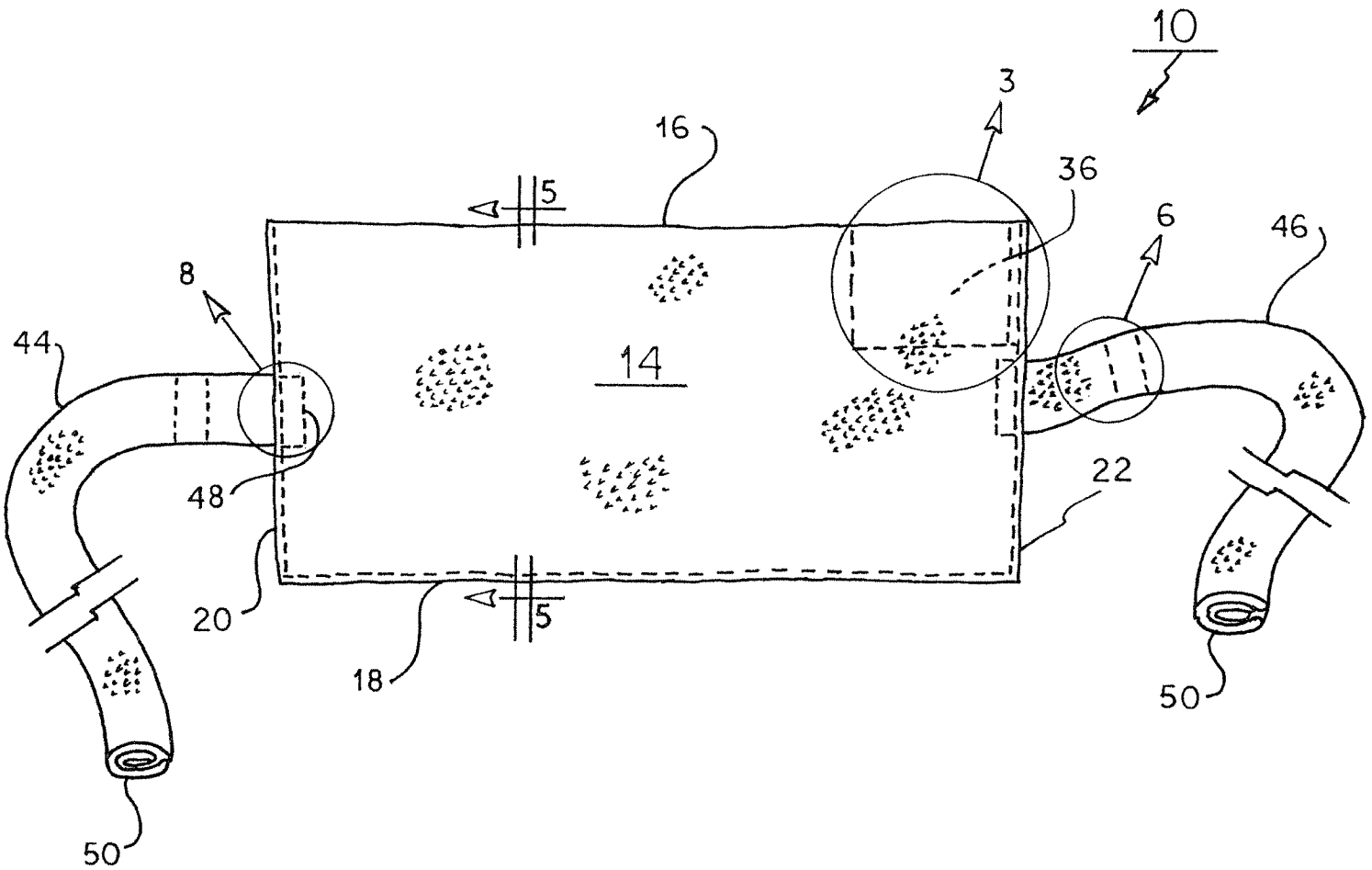
FIG. 2 is an enlarged showing of the stretch/exercise towel system shown in FIG. 1.
Figure 5:
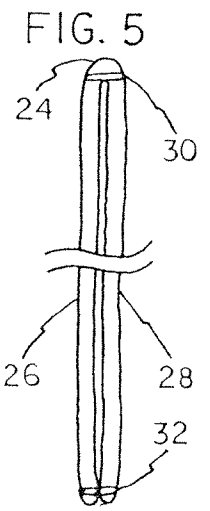
FIG. 5 is a cross sectional view taken along line 5-5 of FIG. 2.
Figure 4:
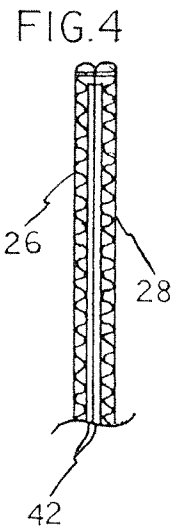
FIG. 4 is an end elevational view taken at line 4-4 of FIG. 3.
Figure 3:
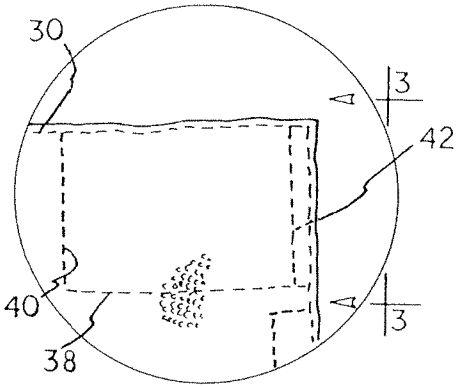
FIG. 3 is an enlarged front elevational view taken at circle 3 of FIG. 2.
Figure 8:
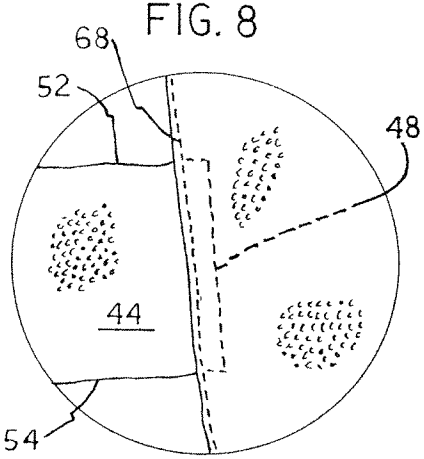
FIG. 8 is an enlarged front elevational view taken at circle 8 of FIG. 2.
Figure 7:
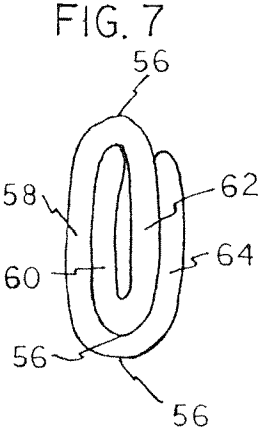
FIG. 7 is a cross sectional view taken along line 7-7 of FIG. 6.
Figure 6:
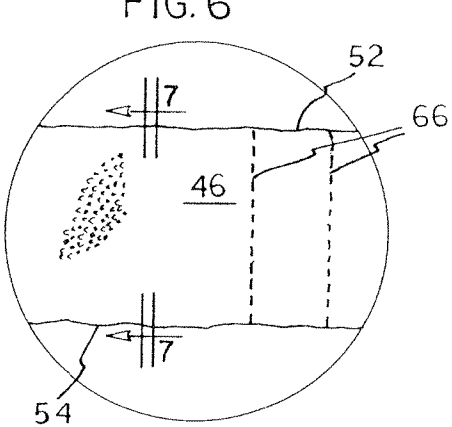
FIG. 6 is an enlarged front elevational view taken at circle 6 of FIG. 2.

With reference now to the drawings, and in particular to FIG. 1 thereof, the preferred embodiment of the new and improved stretch/exercise towel system embodying the principles and concepts of the present invention and generally designated by the reference numeral 10 will be described.

The present invention, the stretch/exercise towel system 10 is comprised of a plurality of components. Such components in their broadest context include a central section and left and right straps. Such components are individually configured and correlated with respect to each other so as to attain the desired objective.

First provided is a central section 14. The central section has an upper edge 16 and a parallel lower edge 18. The upper and lower edges are separated by a height, the preferred height being 7.5 inches, plus or minus 20 percent. The central section has a centerline parallel with and equally spaced from the upper and lower edges. The central section has a first side edge 20 and a parallel second side edge 22. The first and second side edges are separated by a width, the preferred width being 26 inches, plus or minus 20 percent. The central section is fabricated of pile type fabric. The fabric has a fold 24 located centrally between the first and second side edges to form two plies 26, 28. Upper stitching 30 is provided at the upper edge adjacent to the fold. Lower stitching 32 is provided at the lower edge remote from the fold.

Provided next is a pocket 36. The pocket is formed between the plies of, the central section adjacent to the upper edge and second side edge. The pocket is formed by a line of stitching 38 parallel with the upper edge extending from the side edge with the line of stitching being a preferred 6 inches, plus or minus 20 percent. The pocket is also formed by a line of stitching 40 parallel with the second side edge extending from the upper edge with the line of stitching being a preferred 6 inches, plus or minus 20 percent. The pocket also being formed by a line of hook and loop fasteners 42 along the second side edge 22 extending from the upper edge with line of hook and loop fasteners being a preferred 4 inches, plus or minus 20 percent.

Provided last are a left strap 44 and a similarly configured right strap 46. The left and right straps each have an interior edge 48 and an exterior edge 50. The interior and exterior edges of each strap are spaced by a length. The preferred length is 12 inches, plus or minus 20 percent, in the preferred embodiment. The central section has a length which constitutes between 47 and 57 percent of the length of the system. The height of the central section is between 3 and 4 times the width of the straps.

The left and right straps each have an upper edge 52 and a lower edge 54. The upper and lower edges of each strap are spaced by a height. The preferred height is 2 inches, plus or minus 20 percent. Each strap is fabricated of pile type fabric with three parallel fold lines 56 between the interior edge and the exterior edge. In this manner four plies 58, 60, 62, 64 are formed. Strap stitching 66 extends through the four plies of each of the straps perpendicular to the upper edge and lower edge of each of the straps. In the preferred embodiment, the strap stitching is a 2 inch line, plus or minus 20 percent. Coupling stitching 68 joins each of the straps to the central section at a location equally spaced between the interior and exterior edges. In the preferred embodiment, each line of coupling stitching is a 2 inch line, plus or minus 20 percent.

The straps are adapted to be held in the hands of the user with the central section in contact with the back of the user while the user rubs the central section in a direction parallel with the upper and lower edges of the central section to dry the back, to stretch, and to exercise the muscles of the upper body of the user.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stretch/exercise towel system for stretching arm, chest and back muscles of a user and for drying a back of the user, the stretching and drying being done in a safe, convenient and economical manner, the system comprising, in combination:

a central section having an upper edge and a parallel lower edge, the upper and lower edges being separated by a height, a centerline parallel with and equally spaced from the upper and lower edges, the central section having a first side edge and a parallel second side edge, the first and second side edges being separated by a width, the central section being fabricated of pile type fabric with a fold centrally between the first side edge and the second side edge to form two plies, upper stitching at the upper edge adjacent to the fold, lower stitching at the lower edge remote from the fold;

a pocket formed between the plies of the central section adjacent to the upper edge and the second side edge, the pocket being formed by a line of stitching parallel with the upper edge extending from the second side edge, the pocket being formed by a line of stitching parallel with the second side edge extending from the upper edge, the pocket being formed by a line of hook and loop fasteners along the second side edge extending from the upper edge; and a left strap and a similarly configured right strap, the left strap and the right strap each having an interior edge and an exterior edge spaced by a length, the left strap and the right strap each having an upper edge and a lower edge spaced by a height, the length of the central section being between 47 and 57 percent of the length of the system, the width of the central section being from 3 and 4 times greater than the width of the straps, each strap being fabricated of pile type fabric with three parallel fold lines between the interior edge and the exterior edge to form four plies, strap stitching extending through the four plies of each of the straps perpendicular to the upper edge and lower edge of each strap, coupling stitching joining each of the straps to the central section at a location equally spaced between the upper edge and lower edge of the central section;

the straps adapted to be held in hands of the user with the central section in contact with the back of the user while the user rubs the central section in a direction parallel with the upper edge and lower edge of the central section to dry the back and for stretching and exercising the muscles of the upper body of the user.

2. The system as set forth in claim 1 wherein:

the upper edge and the lower edge of the central section are separated by a height of 7.5 inches, plus or minus 20 percent, and the first side edge and second side edge of the central section are separated by a width of 26 inches, plus or minus 20 percent;

the interior edge and exterior edge of each of the straps are spaced by a length of 12 inches, plus or minus 20 percent; and the upper edge and lower edge of each of the straps are spaced by a height of 2 inches, plus or minus 20 percent.

3. The system as set forth in claim 1 wherein:

the strap stitching is a 2 inch line of stitching, plus or minus 20 percent; and the coupling stitching is 2 inch line of stitching, plus or minus 20 percent.

* * * * *